US010872550B2

(12) United States Patent
Li et al.

(10) Patent No.: US 10,872,550 B2
(45) Date of Patent: Dec. 22, 2020

(54) DISPLAY DRIVER AND DISPLAYING METHOD FOR CASCADE APPLICATION

(71) Applicant: Novatek Microelectronics Corp., Hsinchu (TW)

(72) Inventors: Jen-Wei Li, Taichung (TW); Jen-Hao Liao, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 13 days.

(21) Appl. No.: 16/365,711

(22) Filed: Mar. 27, 2019

(65) Prior Publication Data

US 2020/0312208 A1 Oct. 1, 2020

(51) Int. Cl.
*G09G 3/20* (2006.01)

(52) U.S. Cl.
CPC ..... *G09G 3/20* (2013.01); *G09G 2310/0297* (2013.01); *G09G 2320/0276* (2013.01); *G09G 2320/0673* (2013.01)

(58) Field of Classification Search
CPC ..... G09G 3/20; G09G 2310/0297; G09G 2320/0276; G09G 2320/0673
See application file for complete search history.

(56) References Cited

U.S. PATENT DOCUMENTS

2004/0233182 A1* 11/2004 Chuang ..... G09G 3/3696 345/204
2007/0182683 A1* 8/2007 Chin ..... G09G 3/3688 345/88
2008/0001901 A1* 1/2008 Lee ..... G09G 3/3688 345/100
2015/0170609 A1* 6/2015 Jung ..... G09G 3/20 345/212
2017/0162108 A1* 6/2017 Jo ..... G09G 3/3275

* cited by examiner

*Primary Examiner* — Michael J Jansen, II
*Assistant Examiner* — Sosina Abebe
(74) *Attorney, Agent, or Firm* — JCIPRNET

(57) ABSTRACT

A display driver that includes a first driver integrated circuit being cascaded to a second driver integrated circuit is introduced. The first driver integrated circuit includes a first gamma voltage generator that is configured to output a plurality of first gamma voltages to output terminals of the first gamma voltage generator. The second driver integrated circuit includes a second gamma voltage generator that is configured to output a plurality of second gamma voltages to output terminals of the second gamma voltage generator. Each of the output terminals of the first gamma voltage generator is corresponded to one of the output terminals of the second gamma voltage generator. At least one of the output terminals of the first gamma voltage generator is electrically coupled to the corresponding one of the output terminals of the second gamma voltage generator to output at least one common gamma voltage of the first gamma voltages and the second gamma voltages. A method adapted to the display driver is also introduced.

14 Claims, 9 Drawing Sheets

210

DISPLAY DRIVER AND DISPLAYING METHOD FOR CASCADE APPLICATION

BACKGROUND

Technical Field

The disclosure generally relates to data display, and more particularly relates to a display driver and a displaying method that are capable of improving display quality for a cascade application.

Description of Related Art

In a cascade application, two or more driver integrated circuits (ICs) may be used to drive a same display panel. However, because of the non-ideal manufacturing and designing processes, the driving voltages generated by two or more driver ICs for displaying same display data may be different, resulting in non-uniformity (such as two-band phenomenon) in the display panel.

As demand for better display quality has grown recently, there has grown a need for more creative method and design to improve the display quality of display devices, specifically for cascade applications.

Nothing herein should be construed as an admission of knowledge in the prior art of any portion of the present disclosure.

SUMMARY

A display driver and a method thereof that are capable of improving the display quality in a cascade application are introduced herein.

The display driver includes a first driver integrated circuit and a second driver integrated circuit. The first driver integrated circuit includes a first gamma voltage generator that is configured to output a plurality of first gamma voltages to output terminals of the first gamma voltage generator. The second driver integrated circuit comprises a second gamma voltage generator that is configured to output a plurality of second gamma voltages to output terminals of the second voltage generator. Each of the output terminals of the first gamma voltage generator is corresponded to one of the output terminals of the gamma voltage generator. The first driver integrated circuit is cascaded to the second driver integrated circuit, and at least one of the output terminals of the first gamma voltage generator is electrically coupled to the corresponding one of the output terminals of the second gamma voltage generator to output at least one common gamma voltage of the first gamma voltages and the second gamma voltages.

The method that is adapted to a display driver having a first driver integrated circuit being cascaded to a second driver integrated circuit is introduced, where the first driver integrated circuit has a first gamma voltage generator and the second driver integrated circuit has a second gamma voltage generator. The method includes steps of selecting m output terminals among n output terminals of the first gamma voltage generator to be electrically coupled to m corresponding output terminals among n output terminals of the second gamma voltage generator; generating m common gamma voltages, wherein each of the m common gamma voltages is generated by either the first gamma voltage generator or the second gamma voltage generator; and providing the m common gamma voltages to the first driver integrated circuit and the second driver integrated circuit.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

It is to be understood that other embodiments may be utilized and structural changes may be made without departing from the scope of the present disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
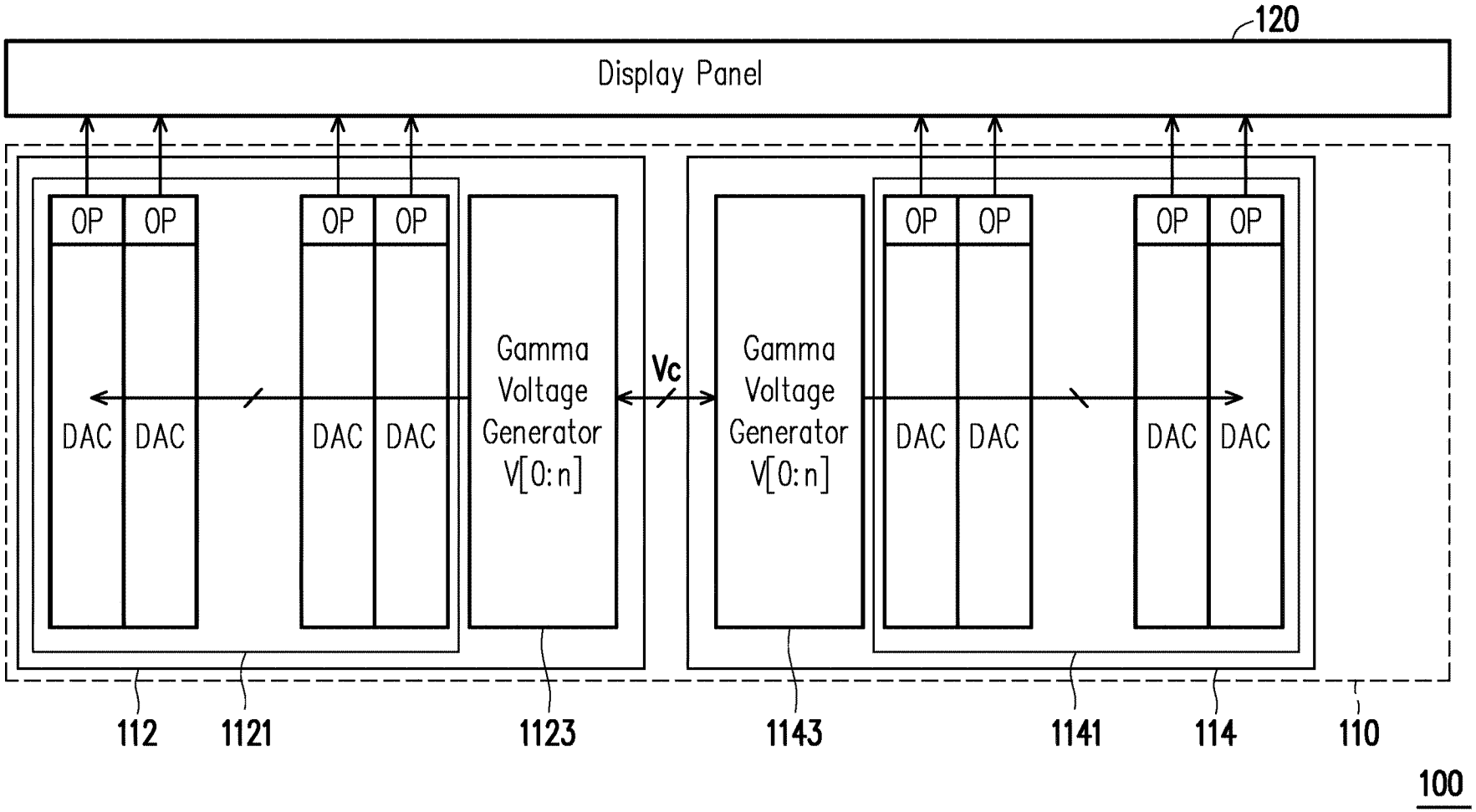
FIG. 1 illustrates a schematic diagram of a display system according to an embodiment of the disclosure.

Referring to FIG. 1, a display system 100 includes a display driver 110 and a display panel 120, in which the display driver 110 is configured to drive the display panel 120. In some embodiments of the disclosure, the display panel 120 may be a liquid crystal display (LCD) panel or an organic light emitting diode (OLED) panel, but the display panel 120 is not limited to any specific type of display panel.

The display driver 110 may include driver integrated circuits (ICs) 112 and 114 being cascaded to each other, where the driver ICs 112 and 114 are configured to drive the display panel 120. The driver IC 112 includes a gamma voltage generator 1123 and a source drive circuit 1121, in which the gamma voltage generators 1123 is configured to generate a plurality of gamma voltages V[0] to V[n] (also known as first gamma voltages), n is a natural number. The first gamma voltages V[0] to V[n] are supplied to the source drive circuit 1121 through the output terminals of the gamma voltage generator 1123. The source drive circuit 1121 is coupled to output terminals of the gamma voltage generator 1123 to receive the gamma voltages V[0] to V[n] from the gamma voltage generator 1123. The source drive circuit 1121 is configured to drive the display panel 120 according to the first gamma voltages V[0] to V[n].

The driver IC 114 includes a gamma voltage generator 1143 and a source drive circuit 1141, in which the gamma voltage generators 1143 is configured to generate a plurality of gamma voltages V[0] to V[n] (also known as second gamma voltages). The second gamma voltages V[0] to V[n] are supplied to the source drive circuit 1141 through the output terminals of the gamma voltage generator 1143. The source drive circuit 1141 is coupled to output terminals of the gamma voltage generator 1143 to receive the gamma voltages V[0] to V[n] from the gamma voltage generator 1143. The source drive circuit 1141 is configured to drive the display panel 120 according to the second gamma voltages V[0] to V[n]. In the embodiment shown in FIG. 2, two driver ICs 112 and 114 are illustrated. However, the disclosure is not limited thereto and the number of cascaded driver ICs could be more than two. In other words, the display driver 110 includes at least two driver ICs.

In some embodiments of the disclosure, each of the output terminals of the gamma voltage generator 1123 corresponds to one of the output terminal of the gamma voltage generator 1143; and at least one output terminal of the gamma voltage generator 1123 is electrically coupled to the corresponding one of the gamma voltage generator 1143 to form common output terminals of the gamma voltage generators 1123 and 1143. The common output terminals output common gamma voltages Vc which is provided to both of the source drive circuit 1121 of the driver IC 112 and the source drive circuit 1141 of the driver IC 114. A number of the common output terminals of the gamma voltage generators 1123 and 1143 is determined according to design needs, and the disclosure is not limited to any specific number of the common output terminals of the gamma voltage generators 1123 and 1143.

Each of the source drive circuits 1121 and 1141 includes a plurality of digital-to-analog converters DACs and a plurality of operational amplifiers OPs, where each of the DACs is electrically coupled to one of the OPs. The source drive circuits 1121 and 1141 are configured to drive the display panel 120 according to the common gamma voltages and non-common gamma voltages outputted by the gamma voltage generators 1123 and 1143.

Figure 2:
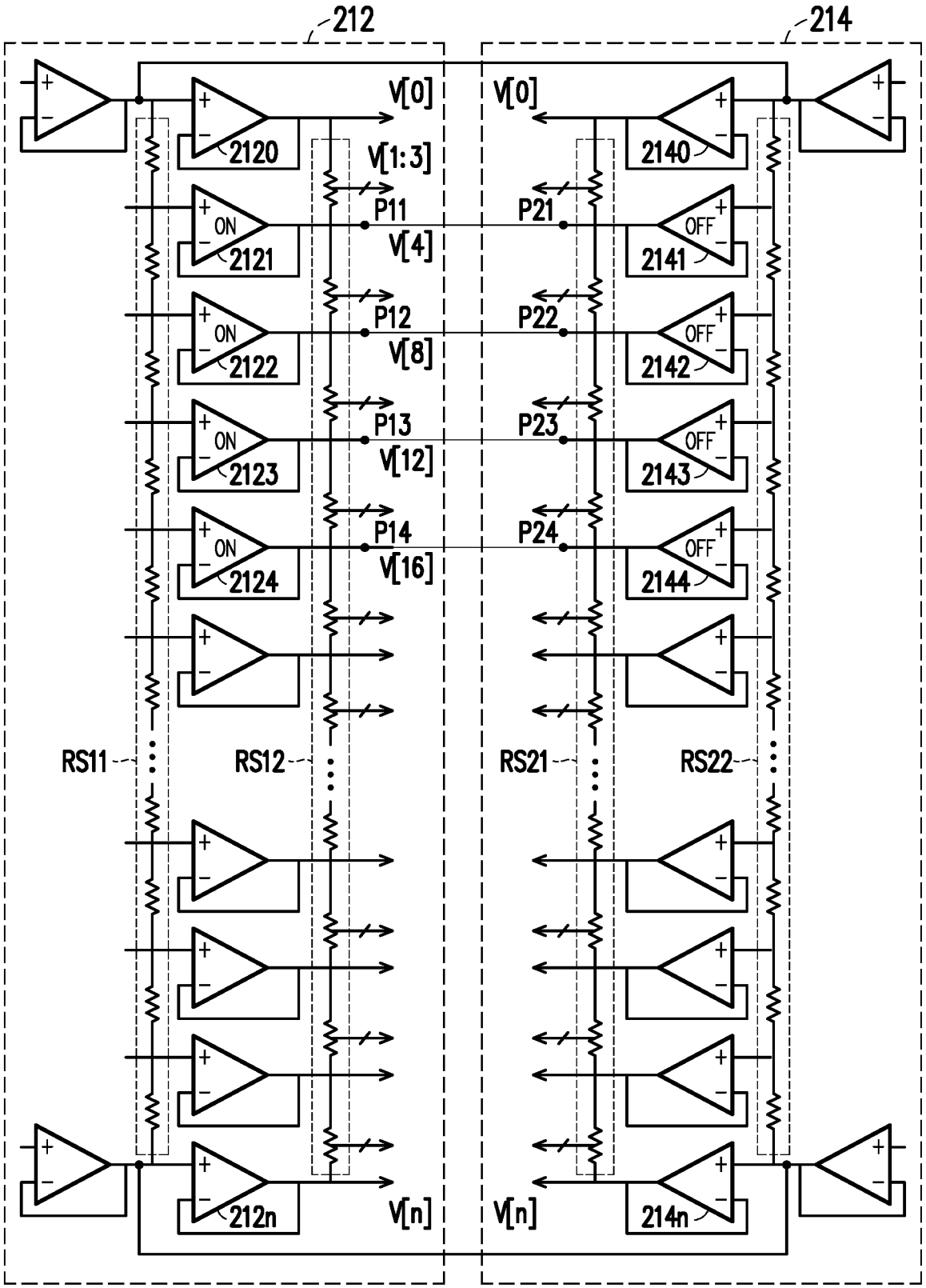
FIG. 2, FIG. 3A, FIG. 3B, FIG. 4A, FIG. 4B, FIG. 5 and FIG. 6 illustrate schematic diagrams of display drivers according to some embodiments of the disclosure.

Referring to FIG. 2, a display driver 210 according to an embodiment of the disclosure is illustrated. The display driver 210 includes a driver IC 212 and a driver IC 214, where the driver IC 212 is cascaded to the driver IC 214 and both of the driver ICs 212 and 214 are configured to drive a display panel (not shown). The driver IC 212 includes a plurality of buffers 2120 to 212*n*, and resistor strings RS11 and RS12. The resistor string RS11 includes a plurality of resistors coupled in series. Each of the buffers 2120 to 212*n* is configured to output one of the gamma voltages. For examples, the buffers 2120, 2121, 2122, 2123 and 2124 outputs the gamma voltages V[0], [V4], V[8], V[12] and V[16], respectively.

The resistor string RS12 includes a plurality of resistors coupled in series, wherein the first resistor of the resistor string RS12 is coupled to the output terminal of the buffer 2120, and the last resistor of the resistor string RS12 is coupled to the output terminal of the buffer 212*n*. The resistor strings RS12 has a plurality of output nodes that outputs gamma voltages among the gamma voltages V[0] to V[n]. For example, the resistor string RS12 generates the gamma voltages V[1:3], V[5:7], V[9:11], and so on. In some embodiments of the disclosure, the resistor string RS12 may be considered as the voltage divider circuits that are configured to generate voltages with different voltage levels.

The driver IC 214 includes a plurality of buffers 2140 to 214*n*, and resistor strings RS21 and RS22. The buffers 2140 to 214*n* and resistor strings RS21 and RS22 of the driver IC 214 are similar to the buffers 2120 to 212*n* and the resistors strings RS11 and RS12 of the driver IC 212, respectively. Thus, the detailed description about the buffers 2140 to 214*n* and resistor strings RS21 and RS22 are omitted hereinafter.

In FIG. 2, the output terminals of the buffers 2121 to 2124 of the driver IC 212 are electrically coupled to the output terminals of the buffer 2141 to 2144 of the driver IC 214, respectively, to form common output terminals of the driver IC 212 and the driver IC 214. In other words, the nodes P11, P12, P13 and P14 of the driver IC 212 is electrically coupled to the nodes P21, P22, P23 and P24 of the driver IC 214, respectively. The common output terminals are configured to output common gamma voltages. In the embodiment shown in FIG. 2, the gamma voltages V[4], V[8], V[12] and V[16] are common gamma voltages of the driver IC 212 and the driver IC 214.

In some embodiments of the disclosure, the buffers that are coupled to one common output terminal are operated in opposite states (e.g., ON and OFF states). As an example, the buffers 2121 and 2141 are coupled to the common output terminal, and only one of the buffers 2121 and 2141 is turned on at a time to generate the common gamma voltage V[4]. In other words, the common gamma voltage V[4] is generated by either the buffer 2121 of the driver IC 212 or the corresponding buffer 2141 of the driver IC 214. Similarly, only one of the buffers 2122 and 2142 is turned on at a time to generate the common gamma voltage V[8]; only one of the buffers 2123 and 2143 is turned on at a time to generate the common gamma voltage V[12]; and only one of the buffers 2124 and 2144 is turned on at a time to generate the common gamma voltage V[16].

Figure 3A:
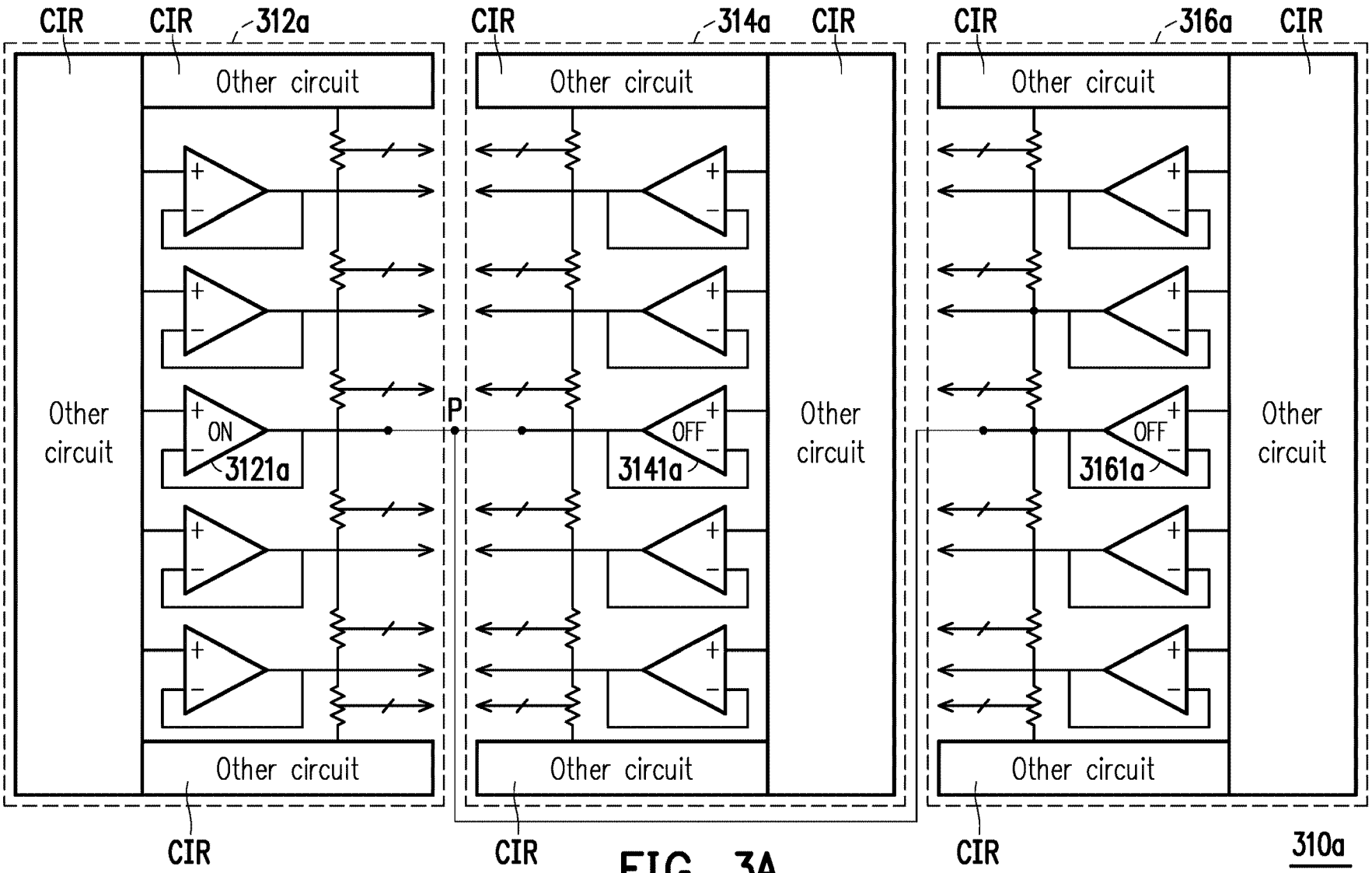

Referring to FIG. 3A, a display driver 310*a* according to an embodiment of the disclosure is illustrated. The display driver 310*a* includes drive ICs 312*a*, 314*a* and 316*a* being cascaded to each other. Each of the driver ICs 312*a*, 314*a* and 316*a* includes a plurality of buffers and a resistor string, where the buffers are similar to the buffer 2120 to 212*n* of the driver IC 212 in FIG. 2, and the resistor string is similar to the resistor string RS12 of the driver IC 212 in FIG. 2. As such, the detailed description about the buffers and the resistor string of each of the driver ICs 312*a*, 314*a* and 316*a* are omitted hereafter.

The driver ICs 312*a*, 314*a* and 316*a* include buffers 3121*a*, 3141*a* and 3161*a*, respectively, where the buffer 3121*a* of the driver IC 312*a* corresponds to the buffer 3141*a* of the driver IC 314*a* and the buffer 3161*a* of the driver IC 316*a*. The output terminals of the buffers 3121*a*, 3141*a* and 3161*a* are all coupled a common node P. A common gamma voltage is generated and outputted to the common node P by one of the buffers 3121*a*, 3141*a* and 3161*a*. For example, if the buffer 3121*a* is turned on to generate the common gamma voltage at the common node P, the other buffers 3141*a* and 3161*a* are turned off. In other words, only one of the buffers 3121*a*, 3141*a* and 3161*a* is turned on at a time to generate the common gamma voltage at the common node P.

Figure 3B:
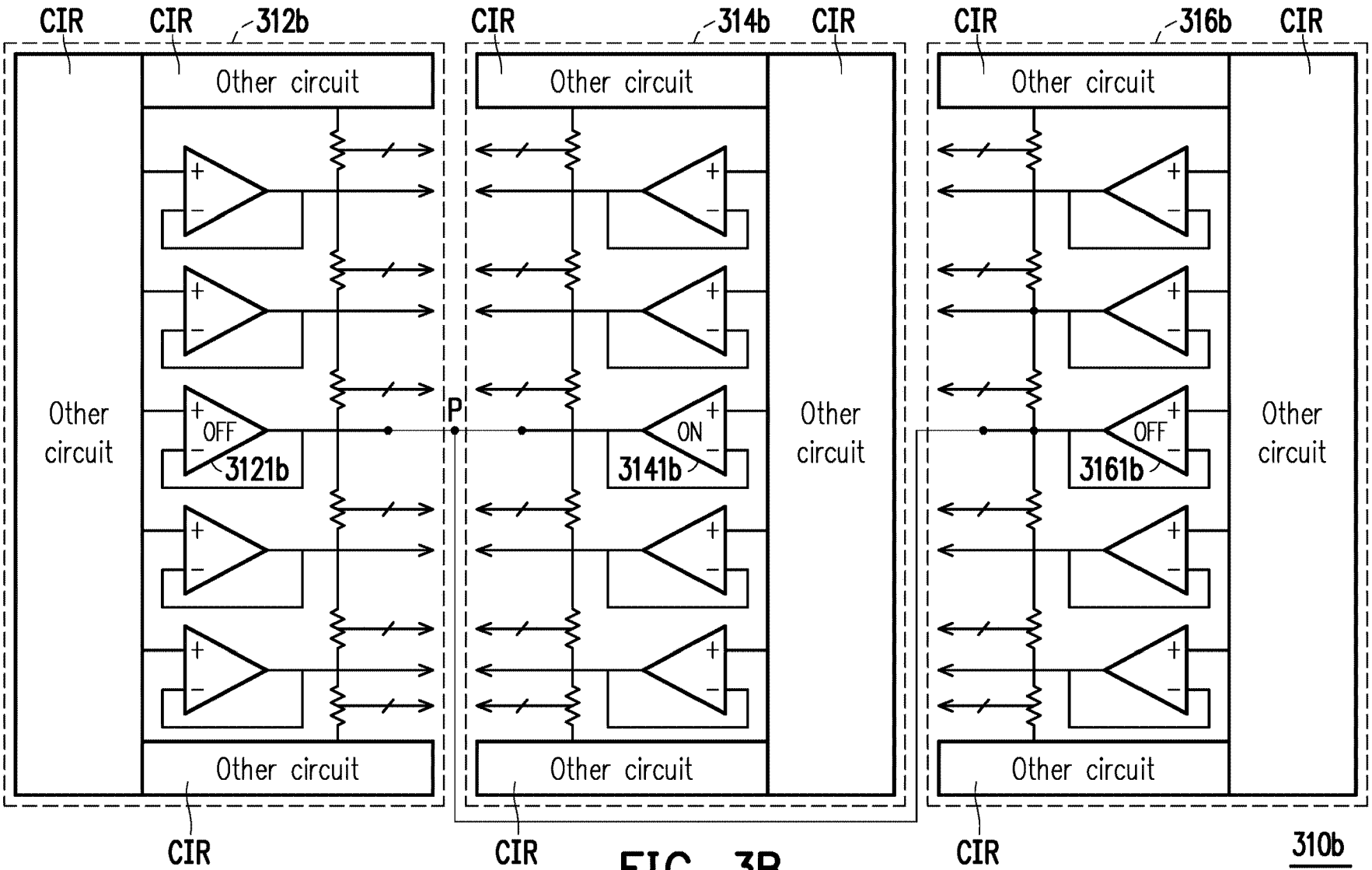

Referring to FIG. 3B, a display driver 310*b* that includes driver ICs 312*b*, 314*b* and 316*b* according to an embodiment of the disclosure is illustrated. The driver ICs 312*b*, 314*b* and 316*b* in FIG. 3B are similar to the driver ICs 312*a*, 314*a* and 316*a* in FIG. 3A, thus the detailed description about the driver ICs 312*b*, 314*b* and 316*b* is omitted hereafter.

A difference between the display driver 310*b* in FIG. 3B and the display driver 310*a* in FIG. 3A is the state of the buffers. In FIG. 3A, the buffer 3121*a* in the driver IC 312 is turned on while the other two corresponding buffers 3141*a* and 3161*a* in the driver ICs 314 and 316 are turned off at a time to generate the common gamma voltage at the common node P. In FIG. 3B, the buffer 3141*b* is turned on while the other two corresponding buffers 3121*b* and 3161*b* of the driver ICs 312 and 316 are turned off at a time to generate the common gamma voltage at the common node P. In other words, only one of the buffers 3121*b*, 3141*b* and 3161*b* that are coupled to the common node P is turned on at a time to generate the common gamma voltage.

Figure 4A:
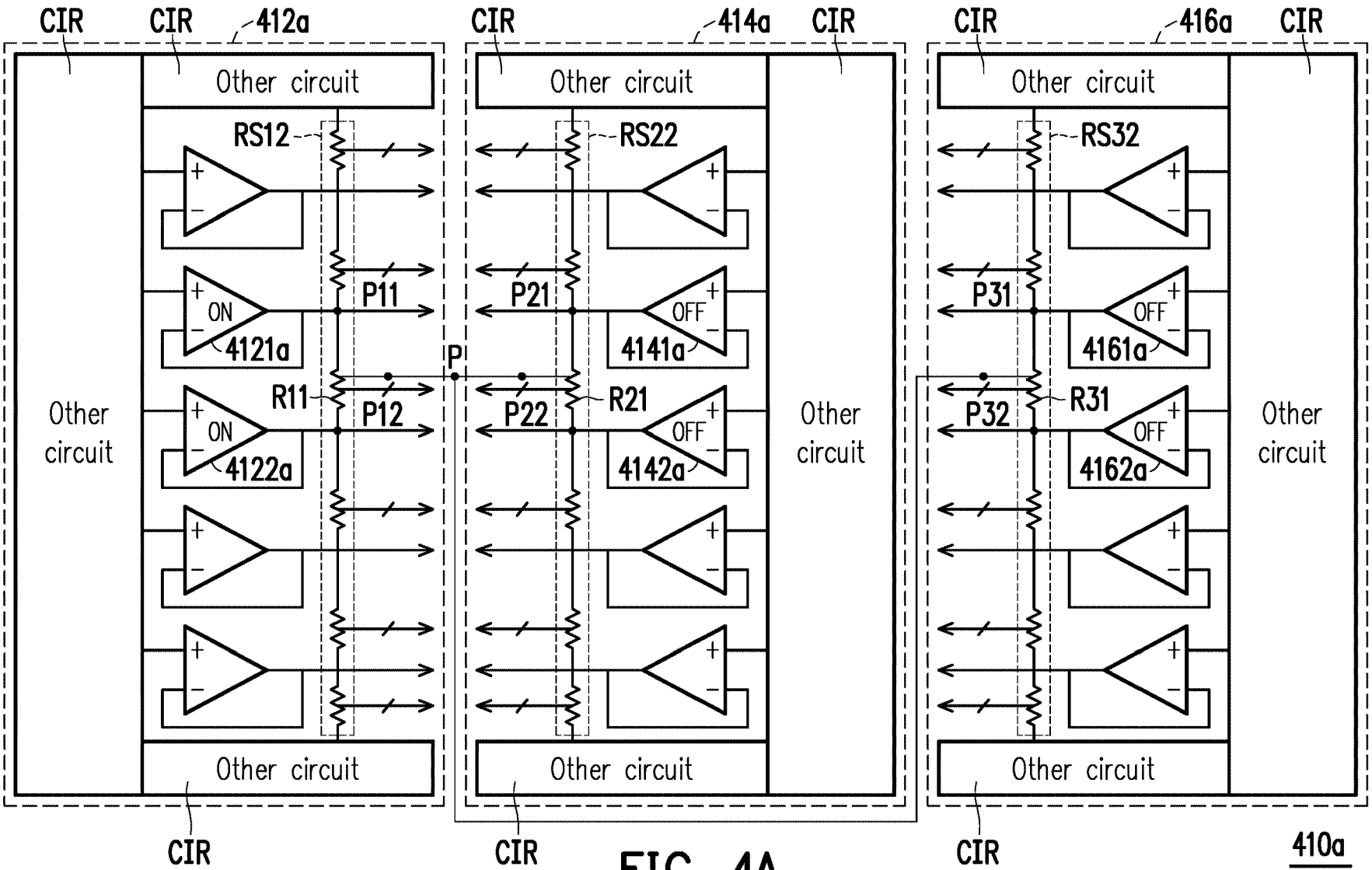

Referring to FIG. 4A, a display driver 410*a* that includes driver ICs 412*a*, 414*a* and 416*a* is illustrated. The driver IC 412*a* includes a resistor Ru coupled between output terminals of buffers 4121*a* and 4122*a* through nodes P11 and P12; the driver IC 414*a* includes a resistor R21 coupled between output terminals of buffers 4141*a* and 4142*a* through nodes P21 and P22; and the driver IC 416*a* includes a resistor R31 coupled between output terminals of buffers 4161*a* and 4162*a* through nodes P31 and P32. The resistor R11 of the resistor string RS12 corresponds to the resistor R21 of the resistor string RS22 and the resistor R31 of the resistor string RS32.

Each of resistor strings RS12, RS22 and RS32 of the driver ICs 412*a*, 414*a* and 416*a*, respectively has a plurality of output nodes to output gamma voltages. The output node corresponding to the resistor R11 of the resistor string RS12 is electrically coupled to the output node corresponding to the resistor R21 of the resistor string RS22 and the output node that corresponds to the resistor R31 of the resistor string RS32. In other words, there is a common output node P that is electrically coupled to the output nodes corresponding to the resistors R11, R21 and R31.

In FIG. 4A, the buffer 4121*a* of the driver IC 412*a* corresponds to the buffer 4141*a* of the driver IC 414*a* and the buffer 4161*a* of the driver IC 416*a*; and the buffer 4122*a* of the driver IC 412*a* corresponds to the buffer 4142*a* of the driver IC 414*a* and the buffer 4162*a* of the driver IC 416*a*. During an operation, only one of the buffers 4121*a*, 4141*a* and 4161*a* are turned on at a time; and only one of the buffer 4122*a*, 4142*a* and 4162*a* are turned on at the same time. As shown in FIG. 4, only the buffer 4121*a* is turned on while the corresponding buffers 4141*a* and 4161*a* are turned off. Similarly, only the buffer 4122*a* is turned on while the corresponding buffers 4142*a* and 4162*a* are turned off. In this way, the common gamma voltage is generated at the common output node P, and this common gamma voltage is provided to source drive circuits (not shown) of all driver ICs 412*a*, 414*a* and 416*a* to drive the display panel (not shown).

Figure 4B:
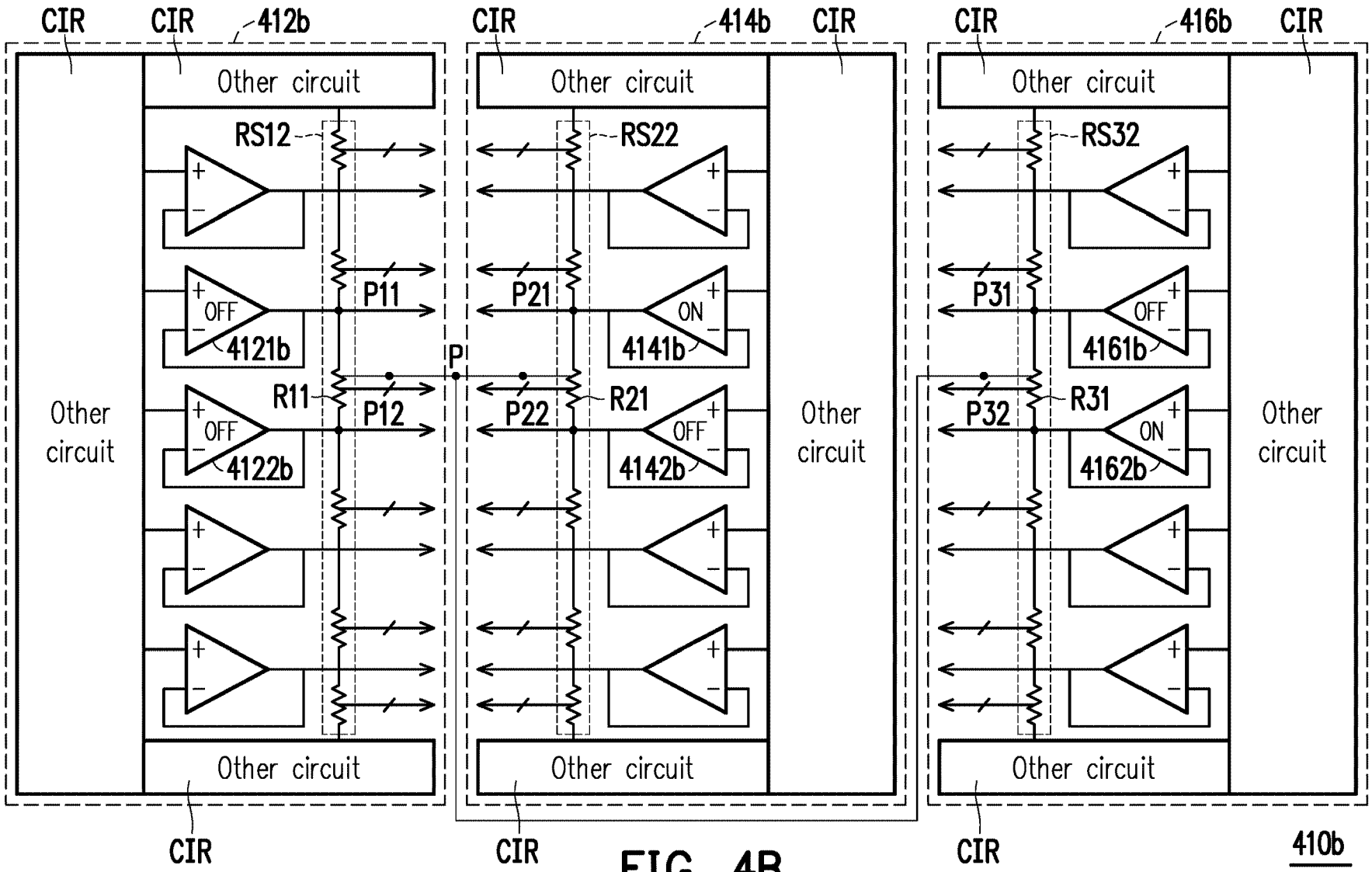

Referring to FIG. 4B, a display driver 410*b* that includes driver ICs 412*b*, 414*b* and 416*b* according to an embodiment of the disclosure is illustrated. The driver ICs 412*b*, 414*b* and 416*b* in FIG. 4B are similar to the driver ICs 412*a*, 414*a* and 416*a* in FIG. 4A, thus the detailed description about the driver ICs 412*b*, 414*b* and 416*b* is omitted hereafter.

A difference between the display driver 410*b* in FIG. 4B and the display driver 410*a* in FIG. 4A is the state of the buffers. In FIG. 4A, the buffer 4121*a* and 4122*a* of the driver IC 412*a* are turned on while the other corresponding buffers 4141*a*, 4161*a*, 4142*a* and 4162*a* are turned off at a time to generate the common gamma voltage at the common node P. In FIG. 4B, the buffer 4141*b* of the driver IC 414*b* is turned on while the corresponding buffers 4121*b* and 4161*b* of the driver ICs 412*b* and 416*b* are turned off. Meanwhile, the buffer 4162*b* of the driver IC 416*b* is turned on while the corresponding buffers 4122*b* and 4142*b* of the driver ICs 412*b* and 414*b* are turned off.

Figure 5:
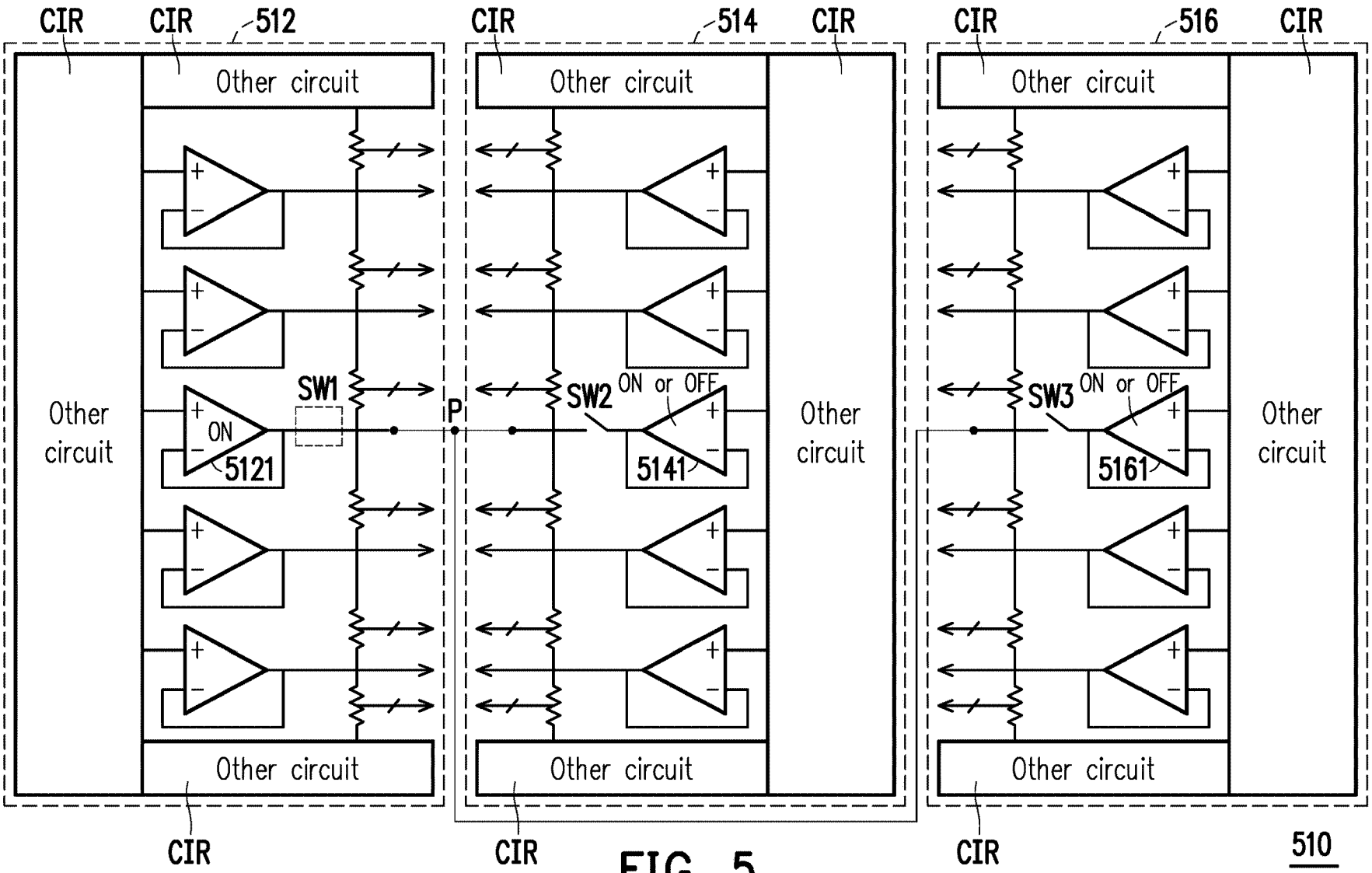

Referring to FIG. 5, a display driver 510 that includes driver ICs 512, 514 and 516 according to an embodiment of the disclosure is illustrated. Each of the driver ICs 512, 514 and 516 includes a plurality of buffers and a resistor string that are similar to the buffers and resistor strings shown in FIG. 3A, thus the detailed description about the buffers and the resistor strings of the driver ICs 512, 514 and 516 is omitted hereafter.

The driver ICs 512, 514 and 516 include the buffers 5121, 5141 and 5161, respectively, where the buffer 5121 of the driver IC 512 corresponds to the buffer 5141 of the driver IC 514 and the buffer 5161 of the driver IC 516. The driver ICs 512, 514 and 516 further include switches SW1, SW2 and SW3, wherein the switch SW1 is coupled between the output terminal of the buffer 5121 and a common node P, the switch SW2 is coupled between the output terminal of the buffer 5141 and the common node P, and the switch SW3 is coupled between the output terminal of the buffer 5161 and the common node P. The switches SW1, SW2, SW3 are configured to electrically connect or electrically isolate the common node P from the buffers 5121, 5141 and 5161, respectively.

During an operation, the switches SW1, SW2 and SW3 are controlled such that only one of the buffer 5121, 5141 and 5161 is configured to generate a common gamma voltage at the common node P. For example, the switches SW1, SW2 and SW3 are controlled to electrically coupled the output terminal of the buffer 5121 to the common node P and isolate the output terminals of the buffers 5141 and 5161 from the common node P. Meanwhile, the buffer 5121 of the driver IC 512 is turned on to generate the common gamma voltage at the common node P. In this way, regardless of the states of the buffers 5141 and 5161 (e.g., ON state or OFF state), only the gamma voltage generated by the buffer 5121 of the driver IC 512 is provided to the common node P.

Figure 6:
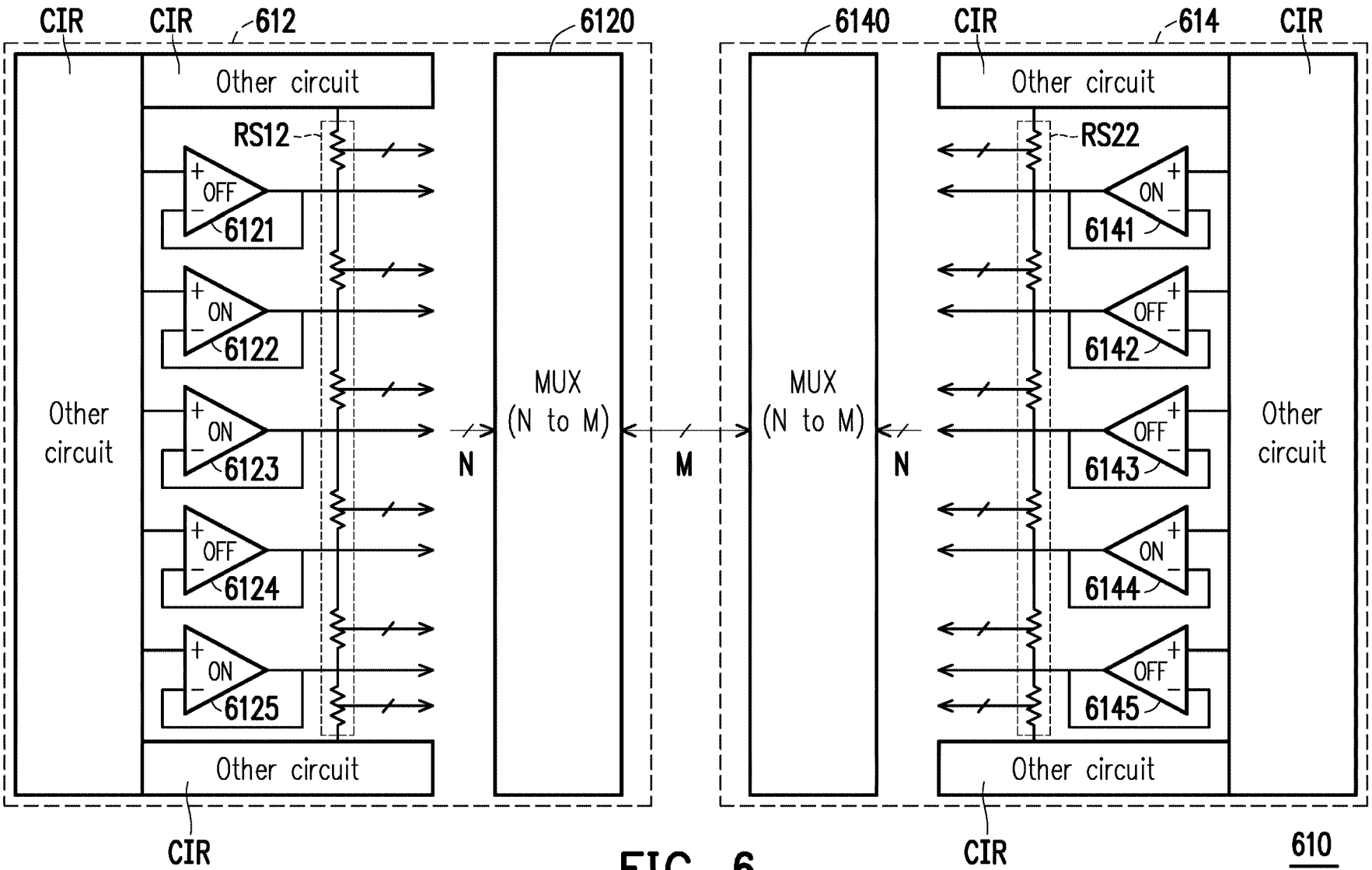

Referring to FIG. 6, a display driver 610 that includes driver ICs 612 and 614 according to an embodiment of the disclosure is illustrated. Each of the driver ICs 612 and 614 includes a plurality of buffers and a resistor string for generating a plurality of gamma voltages. Particular, the driver IC 612 includes buffers 6121 to 6125 and a resistor string RS11; and the driver IC 614 includes buffers 6141 to 6145 and the resistor string RS22. The buffers and the resistor string of the driver ICs 612 and 614 in FIG. 6 are similar to the buffers and the resistor string in FIG. 2, thus the detailed description about the buffers and the resistor string of the driver ICs 612 and 614 is omitted hereafter.

The driver IC 612 further includes a multiplexer 6120 which is coupled to the output terminals of the resistor string RS12 and the output terminals of the buffers 6121 to 6125; and the driver IC 614 further includes a multiplexer 6140 which is coupled to the output terminals of the resistor string RS22 and the output terminals of the buffers 6141 to 6145. In some embodiments, the multiplexers 6120 and 6140 may be n-to-m multiplexers that are configured to select M out of N input signals, where N and M are natural number, and M is smaller than N. The multiplexers 6120 may select M out of N output nodes of the buffers 6121 to 6125 and the resistor string RS12. The multiplexer 6140 may select M out of N output nodes of the of the buffers 6141 to 6145 and the resistor string RS22, wherein the M output nodes selected by the multiplexer 6140 are corresponded to the M output nodes selected by the multiplexer 6120.

The M output nodes selected by the multiplexer 6140 is electrically coupled to the corresponding M output nodes selected by the multiplexer 6120 to form M common output nodes, where M output nodes output M common gamma voltages for the driver ICs 612 and 614. The buffers of the driver IC 612 and the corresponding buffers of the driver IC 614 that are related to the selected M output nodes are controlled such that only one of the buffer from the driver IC 612 and the corresponding one of the driver IC 614 are turned on at a time. For example, when the multiplexer 6120 and 6140 select to connect the output nodes of the buffers 6121 to 6125 of the driver IC 612 to the corresponding output nodes of buffers 6141 to 6145 of the driver IC 614, only one of the buffers 6121 and 6141 are turned on at a time, only one of the buffer 6122 and 6142 are turned on at a time, and so on.

In an alternative embodiment, when the multiplexers 6120 and 6140 select to connect an output node of the resistor string RS12 of the driver IC 612 to the corresponding output node of the resistor string RS22 of the driver IC 614, the buffers related to the output node of the resistor string RS12 and the corresponding buffers related to the corresponding output node of the resistor string RS22 are controlled such that only one of the buffer from the driver IC 612 and the corresponding one of the driver IC 614 are turned on at a time. For example, when the multiplexers 6120 and 6140 select to connect an output node of the resistor located between the buffer 6121 and 6122 of the resistor string RS12 to the output node of the resistor located between the buffer 6141 and 6142 of the resistor string RS22, the buffers 6121 and 6122 of the driver IC 612 and the corresponding buffers 6141 and 6142 of the driver IC 614 are controlled such that only one of the buffer 6121 and the corresponding buffer 6141 is turned on at a time, and only one of the buffer 6122 and the corresponding buffer 6142 is turned on at a time.

In FIG. 3A to FIG. 6, the display driver further includes other circuits CIR that are configured to cooperate with the buffers and resistor string of each of the driver ICs to generate the gamma voltages and to drive the display panel. One of skilled in the arts would be clear about the structure and operation of the other circuits CIR as shown in FIG. 3A to FIG. 6, thus the detailed description about the other circuits CIR of FIG. 3A to FIG. 6 is omitted hereafter.

Figure 7:
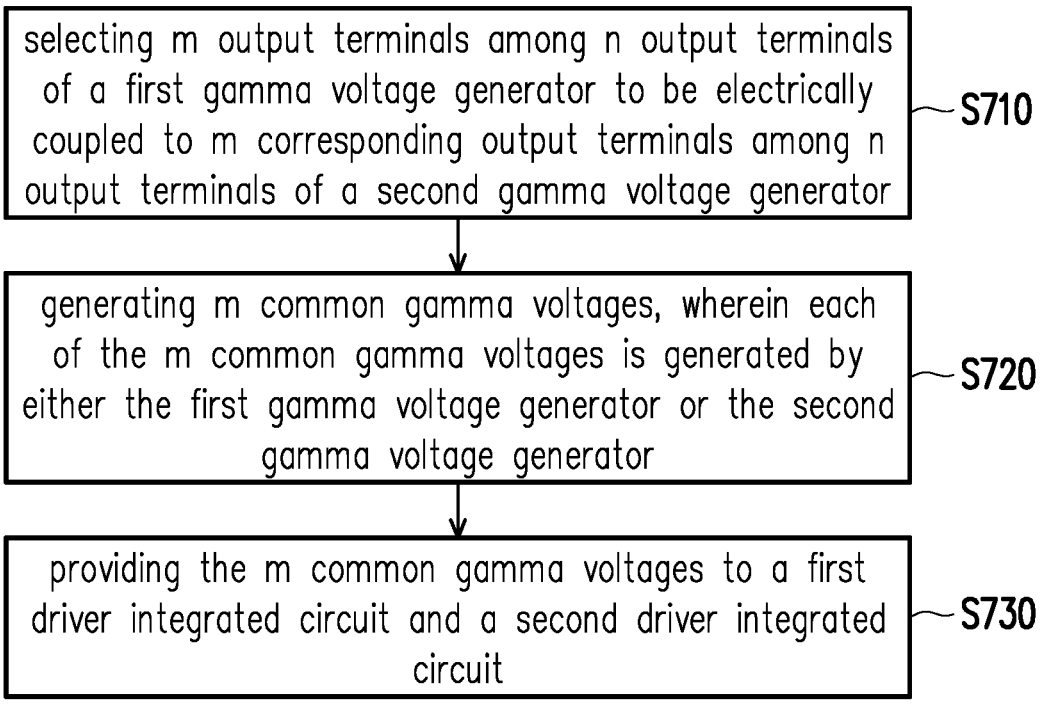
FIG. 7 illustrates a flowchart diagram of a method adapted to a display driver according to an embodiment of the disclosure.

Referring to FIG. 7, a flowchart of a method adapted to a display driver having a first driver integrated circuit being cascaded to a second driver integrated circuit is illustrated, wherein the first driver integrated circuit comprising a first gamma voltage generator and the second driver integrated circuit comprising a second gamma voltage generator. In step S710, m output terminals among n output terminals of the first gamma voltage generator are selected to be electrically coupled to m corresponding output terminals among n output terminals of the second gamma voltage generator. In step S720, m common gamma voltages are generated, wherein each of the m common gamma voltages is generated by either the first gamma voltage generator or the second gamma voltage generator. In step S730, the m common gamma voltages are provided to the first driver integrated circuit and the second driver integrated circuit.

From the above embodiments, at least one common output nodes (output terminals) of gamma voltage generators in different driver ICs are formed to generate at least one common gamma voltage, where each of the at least one common gamma voltage is generated by only one of the gamma voltage generators. The common gamma voltage will be provided to source drive circuits of different driver ICs so as to drive a display panel. In this way, the display uniformity is achieved and the display quality is improved for a cascade application.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A display driver, comprising:

a first driver integrated circuit, comprising a first gamma voltage generator configured to output a plurality of first gamma voltages to output terminals of the first gamma voltage generator, a second driver integrated circuit, comprising a second gamma voltage generator configured to output a plurality of second gamma voltages to output terminals of the second gamma voltage generator, wherein each of the output terminals of the first gamma voltage generator is corresponded to one of the output terminals of the second gamma voltage generator, wherein the first driver integrated circuit cascaded to the second driver integrated circuit, at least one of the output terminals of the first gamma voltage generator is electrically coupled to the corresponding one of the output terminals of the second gamma voltage generator to form a common output terminal, and at least one common gamma voltage of the first gamma voltages and the second gamma voltages is outputted to the common output terminal.

2. The display driver of claim 1, wherein the first driver integrated circuit further comprises a first source driver circuit being coupled to the first gamma voltage generator, the first source driver circuit is configured to drive a display panel according to the at least one common gamma voltage, the second driver integrated circuit further comprises a second source driver circuit being coupled to the second gamma voltage generator, the second source driver circuit is configured to drive the display panel according the at least one common gamma voltage.

3. The display driver of claim 2, wherein the at least one common gamma voltage comprises a first common gamma voltage, the first common gamma voltage is generated by either the first gamma voltage generator or the second gamma voltage generator, and the first common gamma voltage is outputted to both of the first source drive circuit and the second source drive circuit.

4. The display driver of claim 3, wherein the first gamma voltage generator comprises:

a plurality of first buffers, each of the first buffers is configured to generate one of the first gamma voltages, and a first resistor string, configured to generate at least one of the first gamma voltages, and the second gamma voltage generator comprises:

a plurality of second buffers, each of the second buffers is configured to generate one of the second gamma voltages; and a second resistor string, configured to generate at least one of the second gamma voltages.

5. The display driver of claim 4, wherein each of the first buffers is corresponded to one of the second buffers, the first common gamma voltage is generated by either one of the first buffers or the corresponding one of the second buffers, wherein the one of the first buffers is electrically connected to the corresponding one of the second buffers.

6. The display driver of claim 5, wherein only one of the one of the first buffers and the corresponding one of the second buffers is turned on at a time.

7. The display driver of claim 5, wherein the first gamma generator further comprises a first switch coupled between an output terminal of the one of the first buffers and the output terminal of the first gamma generator, the second gamma generator further comprises a second switch coupled between an output terminal of the corresponding one of the second buffers and the output terminal of the second gamma generator, and only one of the first switch and the second switch is turned on at a time.

8. The display driver of claim 4, wherein each node in the first resistor string is corresponded to a node in the second resistor string, the first common gamma voltage is generated by either one node of the first resistor string or the corresponding node of the second resistor string, wherein the one node of the first resistor string is electrically connected to the corresponding node of the second resistor string.

9. The display driver of claim 4, wherein each of the first gamma voltage generator and the second gamma voltage generator comprise a multiplexer configured to select m common gamma voltages among n gamma voltages, wherein n and in are natural numbers, and n is greater than m, and each of the m common gamma voltages is generated by either the first gamma voltage generator or the second gamma voltage generator.

10. The display driver of claim 9, wherein m output terminals of the first gamma voltage generator are selected to be coupled to m corresponding output terminals of the second gamma voltage generator through m connection lines, and the first buffers that are related to the m connection lines and the second buffers that are related to the m connection lines are controlled such that the common gamma voltage in each of the in connection lines is generated by either an output terminal of first gamma voltage generator or a corresponding output terminal of the second gamma voltage generator.

11. The display driver of claim 10, wherein them connection lines include a connection line that connects one of the first buffers to a corresponding one of the second buffers, and either one of the first buffers or the corresponding one of the second buffers are turned on at a time to output a common gamma voltage in the connection line.

12. The display driver of claim 10, wherein the m connection lines include a connection line that connects a node of the first resistor string to a corresponding node of the second resistor string, and the first buffers that are related to the node of the first resistor string and the corresponding second buffers that are related to the corresponding one of the second resistor string are controlled such that one of the first buffers that are related to the node of the first resistor string or a corresponding one of the second buffers that are related to the corresponding node of the second resistor string is turned on at a time.

13. A method adapted to a display driver having a first driver integrated circuit being cascaded to a second driver integrated circuit, the first driver integrated circuit comprising a first gamma voltage generator and the second driver integrated circuit comprising a second gamma voltage generator, the method comprising:

selecting m output terminals among n output terminals of the first gamma voltage generator to be electrically coupled to m corresponding output terminals among n output terminals of the second gamma voltage generator to form m common output terminals;

generating m common gamma voltages and outputting the m common gamma voltages to the m common output terminals, wherein each of the m common gamma voltages is generated by either the first gamma voltage generator or the second gamma voltage generator;

providing the m common gamma voltages to the first driver integrated circuit and the second driver integrated circuit.

14. The method of claim 13, wherein the first driver integrated circuit further comprises a first source drive circuit being coupled to the first gamma voltage generator, the second driver integrated circuit further comprises a second source drive circuit being coupled to the second gamma voltage generator, and the m common gamma voltages are provided to both of the first source drive circuit and the second source drive circuit.

* * * * *